US005875506A

United States Patent [19]

Plazanet

[11] Patent Number: 5,875,506

[45] Date of Patent: Mar. 2, 1999

[54] DRIVE DISK FOR THE TOOL OF A MACHINE FOR CONDITIONING AND/OR MAINTAINING FLOORS AND MACHINE PROVIDED WITH A DISK OF THIS KIND

[76] Inventor: Maurice Plazanet, 34, Avenue Jean Racine, 92330 Sceaux, France

[21] Appl. No.: 897,834

[22] Filed: Jul. 21, 1997

[30] Foreign Application Priority Data

Jul. 25, 1996 [FR] France ..... 96 09365

[51] Int. Cl.[6] ..... A47L 11/14

[52] U.S. Cl. ..... 15/98; 15/50.1; 15/230; 451/353

[58] Field of Search ..... 15/49.1, 50.1, 15/98, 180, 230, 230.17; 451/41, 288, 353, 359

[56] References Cited

U.S. PATENT DOCUMENTS

| | | | |
|---|---|---|---|
| 1,808,656 | 6/1931 | Hartman . | |
| 4,443,906 | 4/1984 | Tucker et al. . | |
| 4,999,871 | 3/1991 | Plazanet | 15/230.17 |
| 5,058,229 | 10/1991 | Plazanet | 15/98 |
| 5,230,184 | 7/1993 | Bukhman | 451/41 |
| 5,579,554 | 12/1996 | Plazanet | 15/98 |

FOREIGN PATENT DOCUMENTS

| | | | |
|---|---|---|---|
| 0 388 273 | 3/1990 | European Pat. Off. . | |
| 0 702 925 | 3/1996 | European Pat. Off. . | |
| 861988 | 11/1952 | Germany | 15/180 |
| 11 12 815 | 9/1955 | Germany . | |
| 182178 | 5/1986 | WIPO . | |

*Primary Examiner*—Terrence Till
*Attorney, Agent, or Firm*—Fisher,Christen&Sabol

[57] ABSTRACT

A drive disk for the rotary tool of a machine for conditioning and/or maintaining floors includes a rigid circular plate and a circular diaphragm. In accordance with the invention, the drive disk includes a sealed axial passage passing through it and discharging at one end via a first central orifice in said rigid circular plate and at the other end via a second central orifice in said diaphragm.

5 Claims, 2 Drawing Sheets

DRIVE DISK FOR THE TOOL OF A MACHINE FOR CONDITIONING AND/OR MAINTAINING FLOORS AND MACHINE PROVIDED WITH A DISK OF THIS KIND

BACKGROUND OF THE INVENTION

1. Field of the Invention

The present invention concerns a drive disk for the rotary tool of a machine for conditioning and/or maintaining floors and the machine provided with a disk of this kind.

2. Description of the Prior Art

The document EP-A-0 702 925 describes a drive disk for a machine for conditioning and/or maintaining floors, said machine including a motor adapted to drive at least one rotary tool in rotation via a drive shaft and said drive disk including a rigid circular plate and a circular diaphragm, said circular diaphragm being connected, near its outside periphery, to said rigid circular plate and, near its center, to the drive shaft, and being made from a material that is flexible perpendicularly to its plane but which is rigid in its plane, said tool being fixed to said rigid circular plate on the side opposite said diaphragm, a drive disk of this kind being remarkable in that the cavity formed between said rigid circular plate and said diaphragm is sealed and contains a fluid, for example a liquid such as water, tensioning said diaphragm.

With a drive disk of this kind, it has been found that vibrations at low speed are eliminated if the diaphragm is lightly tensioned, with no negative effect on the properties due to the particular nature of the circular diaphragm. It has also been found that this disk can be used with satisfaction at low rotation speeds as well as at high rotation speeds and that it may be judicious to fill said cavity with liquid to a greater or lesser extent, depending on the rotation speed of the tool and the density of said liquid.

Moreover, as also described in the document EP-A-0 388 273, the diaphragm of this machine known in itself may be constituted of a synthetic material cloth that is rigid in shear in rotation, for example of the type used to manufacture conveyor belts. It may be constituted of criss-cross polyester fiber fabrics coated with polyvinyl chloride.

The object of the present invention is to improve the disk briefly described above so that the floor treatment machine can be fed with a floor treatment or maintenance product (sanding product, polishing product, washing product, etc) in operation.

SUMMARY OF THE INVENTION

To this end, in accordance with the invention, the drive disk for a machine for conditioning and/or maintaining floors, said machine including a motor adapted to drive at least one rotary tool in rotation via a drive shaft and said drive disk including a rigid circular plate and a circular diaphragm, said circular diaphragm being connected, near its outside periphery, to said rigid circular plate and, near its center, to the drive shaft, and being made from a material that is flexible perpendicularly to its plane but which is rigid in its plane, said tool being fixed to said rigid circular plate on the side opposite said diaphragm, the cavity formed between the rigid circular plate and the diaphragm being sealed and containing a fluid tensioning said diaphragm, is remarkable in that it includes a sealed axial passage passing through it and discharging at one end through a first central orifice in said rigid circular plate and at the other end through a second central orifice in said diaphragm.

With a disk of this kind it is possible to feed the tool centrally with a floor treatment or maintenance product of this kind.

In one advantageous embodiment, the machine including the drive disk of the present invention is remarkable in that its drive shaft is hollow and in that a conduit for said floor treatment or maintenance product is housed in said drive shaft and passes through the central passage of said drive disk.

Of course, said conduit can be fed with floor treatment or maintenance product from a tank of such product, optionally associated with a flow control device, in any manner that may be required. For example, a flowrate control device may be provided that enables delivery of the product only while the machine is moving and which interrupts the flow as soon as the machine stops.

Where the drive disk is provided with coupling means to said drive shaft including a rigid circular base attached and sealed to the central part of the diaphragm, said rigid circular base includes a third central orifice in corresponding relationship to the second central orifice of the diaphragm and the seal between the rigid circular base and the diaphragm is effected at the periphery of said superposed second and third central orifices. If an auxiliary membrane delimiting the cavity on the side of the rigid plate is provided, it is advantageous for said auxiliary membrane to include a fourth central orifice in corresponding relationship to said second and third central orifices in the diaphragm and in the circular base, respectively, and for the seal between the rigid circular base, the diaphragm and the auxiliary membrane to be effected at the periphery of said superposed second, third and fourth central orifices.

In the case where the rigid circular plate carries a central projection adapted to cooperate with a central recess of said rotary tool to facilitate fitting, holding and centering it, said central projection includes a central hole facing said first central orifice in the rigid circular plate.

Of course, it is advantageous for the means coupling the disk to the drive shaft to enable easy mounting and demounting of said drive disk onto and from the shaft of the machine. To this end, additional coupling means carried by said drive shaft may be provided to form a removable wedging type coupling.

Moreover, said rotary tool may take many different forms such as a brush, a sanding disk, a polishing disk, etc.

If, in the manner known in itself, the rotary tool includes or consists of a disk of fibrous material, it is advantageous for said rigid circular plate to include hooks for attaching said fibrous material disk on the side opposite said diaphragm. An attachment and fixing system of this kind is advantageously of the type described in patent EP-A-0 347 302.

The figures of the accompanying drawings explain how the invention may be put into effect. In the figures, identical reference numbers designate similar components.

DETAILED DESCRIPTION OF THE PREFERRED EMBODIMENT

Figure 1:
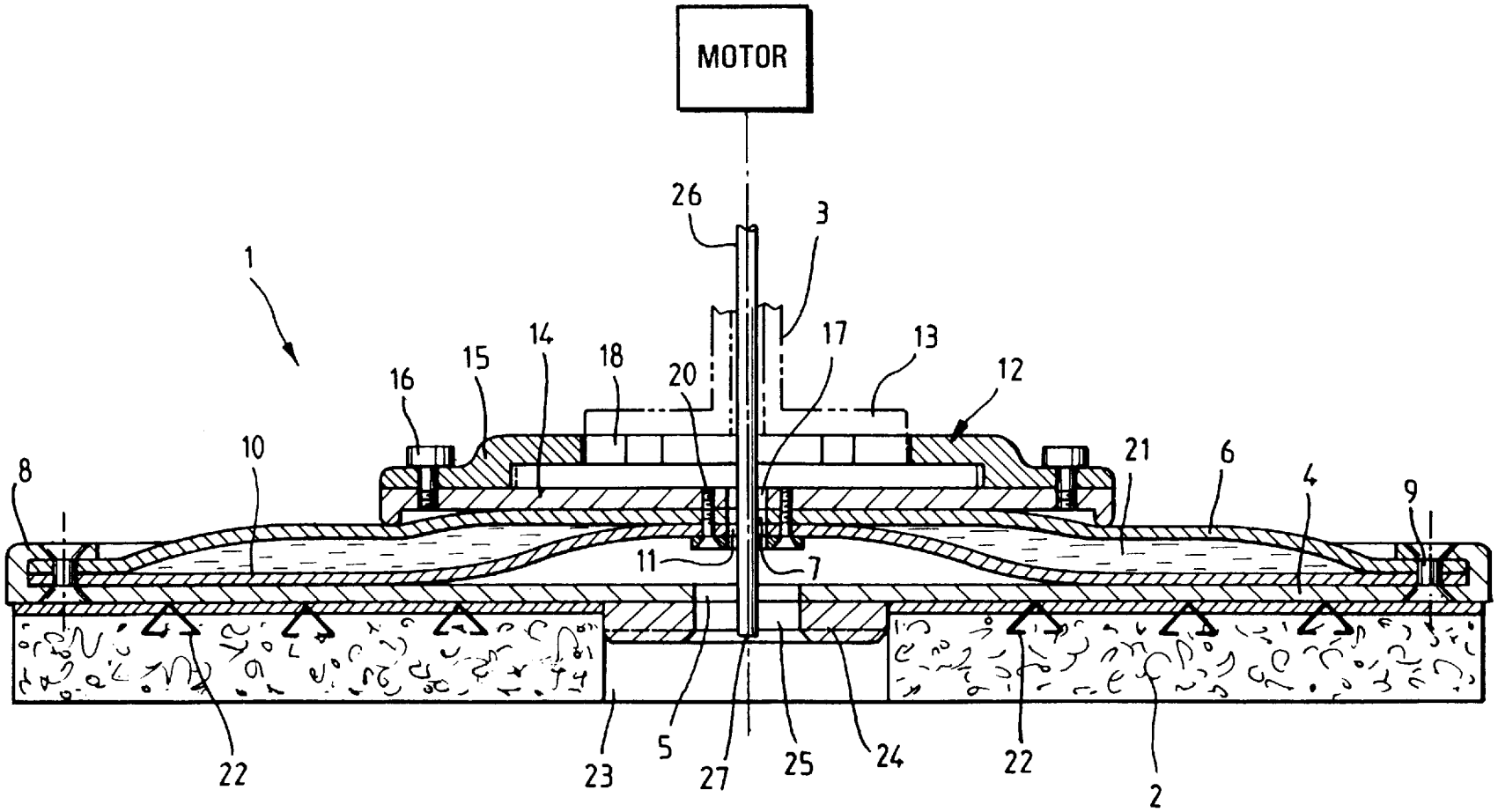
FIG. 1 is a view of one embodiment of the drive disk in accordance with the present invention in axial section taken along the line I—I in FIG. 2.
Figure 2:
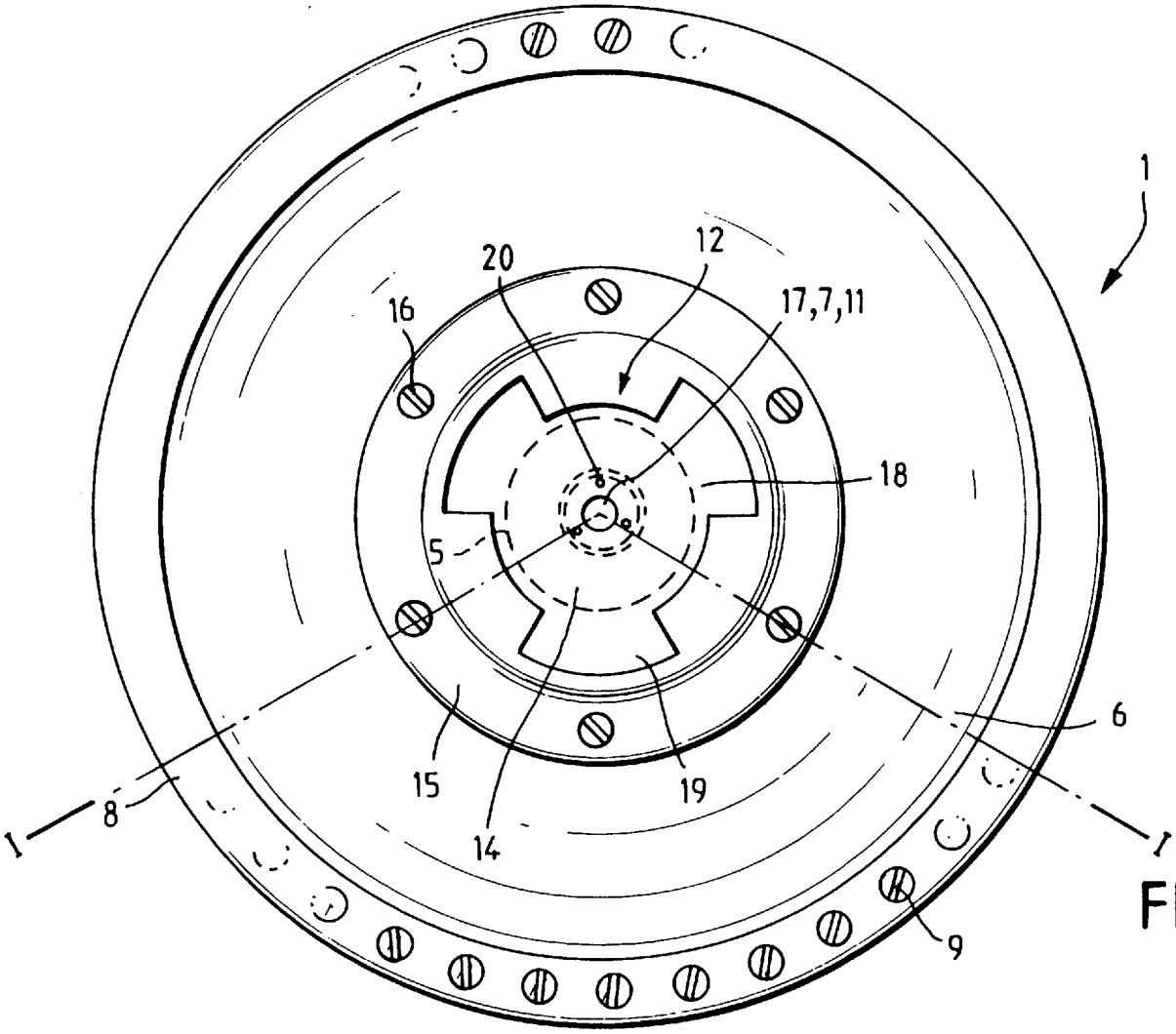
FIG. 2 is a top view of the disk from FIG. 1.

The drive disk 1 in accordance with the present invention shown in FIGS. 1 and 2 is adapted to be mounted on a machine for conditioning and/or maintaining floors (sander, washer, polisher, etc), this machine including a motor (not shown) adapted to drive a rotary tool 2 via a hollow drive shaft 3.

In FIG. 1, it is supposed that the rotary tool 2 is a fibrous material disk, although it can have a different structure, such as that of a brush, for example, and the drive shaft 3 is shown only in dashed outline.

As can be seen in FIG. 1, the drive disk 1 includes a rigid circular plate 4 in which there is a central orifice 5 and a circular diaphragm 6 in which there is also a central orifice 7. The diaphragm is made from a material that is flexible perpendicular to its plane but rigid in its plane, for example a synthetic material cloth rigid in shear in rotation. This cloth may be of the kind used to manufacture conveyor belts, for example. It may be constituted of criss-cross polyester fiber fabrics covered with polyvinyl chloride.

The circular diaphragm 6 is fastened to said rigid plate 4 by flanges 8 and fixing means 9 (for example rivets) and sealed to it, for example by an auxiliary membrane 10 pressed against said rigid plate 4 near the external peripheries of said diaphragm and said rigid circular plate. There is a central orifice 11 in said auxiliary membrane 10.

At the center of the diaphragm 6 there is mounted a female coupling flange 12 adapted to cooperate with a male flange 13 attached to the free end of the drive shaft 3. In FIG. 1 the male flange 13 is shown in dashed outline, like the shaft 3 to which it is attached.

The female flange 12 is constituted by a rigid plane circular base 14 and an inverted cup-shape circular cover 15, said components 14 and 15 being assembled together at their peripheries by fixing means 16 (for example screws).

There is a central orifice 17 in the rigid circular base 14 and a central opening 18 in the circular cover 15, the circular contour of the latter including notches 19. The male flange 13 includes radial fingers having a shape corresponding to that of the notches 19, so that said flanges 12 and 13 form a joggle-type coupling (rotation and wedging).

The orifices 7, 11 and 17 being coaxial, the diaphragm 6, the auxiliary membrane 10 and the circular base 14 are fastened and sealed together by coupling means 20, for example screws, disposed at the periphery of said orifices 7, 11 and 17.

Since the peripheral coupling between the diaphragm 6, the membrane 10 and the plate 4 is sealed and the female flange 12 is centrally mounted on and sealed to the diaphragm 6 and the membrane 10, a sealed cavity 21 is formed between the diaphragm 6 and the membrane 10.

This sealed cavity 21 contains a fluid, in particular a liquid adapted to lightly tension said diaphragm, as shown in FIG. 1. A filling valve (not shown) is provided on said diaphragm.

If the floor treatment machine is designed to drive the rotary disk at a nominal speed of 400 rpm, for example, it is advantageous for said liquid to be water. Accordingly, at rest, the diaphragm 6 remains lightly tensioned (see FIG. 1) in the manner of a hot water bottle and the inclination of the tool 2 relative to the shaft 3 is unrestricted but damped.

For fixing the fibrous tool 2 to the drive disk 1 the side of the rigid circular plate 4 opposite the diaphragm 6 includes projecting hooks 22 adapted to penetrate into the fibrous material of the tool 2.

To facilitate fitting the fibrous tool 2 to the drive disk 1 the tool includes a central recess 23 adapted to cooperate with a projection 24 on the side of the rigid circular plate on which hooks 22 are provided. There is a central opening 25 in said projection 24.

A conduit 26 is housed inside the hollow drive shaft 3, passing through the openings and orifices 18, 17, 11, 5 and 25 and discharging via an orifice 27 into the central recess 23 of the tool 2. At the end opposite the disk 1, the conduit 26 is connected to a tank (not shown) containing a floor treatment product (washing product, sanding product, polishing product, etc).

Evidently, by virtue of the invention, the tool 2 can be fed centrally with a product of this kind via said conduit 26.

It is of course possible to provide a device (not shown) for controlling and/or regulating the flowrate of said product between the product tank and the orifice 27.

There is claimed:

1. A drive disk for a machine for conditioning and/or maintaining floors, said machine including a motor adapted to drive at least one rotary tool in rotation via a drive shaft and said drive disk including a rigid circular plate and a circular diaphragm, said circular diaphragm being connected, near its outside periphery, to said rigid circular plate and, near its center, to said drive shaft, and being made from a material that is flexible perpendicularly to its plane but which is rigid in its plane, said tool being fixed to said rigid circular plate on the side opposite said diaphragm, a cavity formed between said rigid circular plate and said diaphragm being sealed and containing a fluid tensioning said diaphragm, which drive disk is remarkable in that it includes a sealed axial passage passing through it and discharging at one end through a first central orifice in said rigid circular plate and at the other end through a second central orifice in said diaphragm.

2. A drive disk as claimed in claim 1 including coupling means to said drive shaft including a rigid circular base attached and sealed to a central part of said diaphragm, wherein said rigid circular base includes a third central orifice in corresponding relationship to said second central orifice of said diaphragm, and wherein said rigid circular base is sealed to said diaphragm at the periphery of said superposed second and third central orifices.

3. A drive disk as claimed in claim 2 including an auxiliary membrane delimiting said cavity on the same side as said rigid plate and wherein said auxiliary membrane includes a fourth central orifice in corresponding relationship to said second and third central orifices respectively in said diaphragm and in said circular base, and wherein said rigid circular base, said diaphragm and said auxiliary membrane are sealed to each other at the periphery of said superposed second, third and fourth central orifices.

4. A drive disk as claimed in claim 1 wherein said rigid circular plate carries a central projection adapted to cooperate with a central recess of said rotary tool to facilitate fitting, centering and maintaining it, and wherein said central projection includes a central hole facing said first central orifice in said rigid circular plate.

5. A machine for conditioning and/or maintaining floors including a motor adapted to drive at least one rotary tool in rotation via a drive shaft, which machine includes a drive disk for said tool as claimed in claim 1, and wherein said drive shaft is hollow and a conduit for a floor treatment product is housed in said drive shaft and passes through said axial passage of said drive disk.

* * * * *